United States Patent [19]

Hopp

[11] 4,044,485

[45] Aug. 30, 1977

[54] DISPLAY SIGN WITH EDGE ATTACHING FLANGE MEMBERS

[75] Inventor: Philip Hopp, New York, N.Y.

[73] Assignee: The Hopp Press, Inc., New York, N.Y.

[21] Appl. No.: 662,460

[22] Filed: Mar. 1, 1976

[51] Int. Cl.[2] ..... G09F 3/00

[52] U.S. Cl. ..... 40/324; 40/16.4

[58] Field of Search ..... 40/11, 324, 16.4, 16.6

[56] References Cited

U.S. PATENT DOCUMENTS

| | | | |
|---|---|---|---|
| 179,476 | 7/1876 | Hearttagen | 40/16.6 X |
| 1,330,684 | 2/1920 | Chwala | 40/16.6 |
| 1,848,262 | 3/1932 | Meyer | 40/16.6 |
| 2,171,350 | 8/1939 | Anderson | 40/324 |
| 2,276,490 | 3/1942 | Hoofer | 40/11 R |
| 2,779,114 | 1/1957 | Orthwine | 40/11 R |

*Primary Examiner*—John F. Pitrelli
*Assistant Examiner*—Wenceslao J. Contreras

[57] ABSTRACT

A display sign having flange members for removably attaching to the edge of a pan or tray and especially for attachment to a pan or tray having a rolled edge of any material or thickness.

1 Claim, 6 Drawing Figures

DISPLAY SIGN WITH EDGE ATTACHING FLANGE MEMBERS

BACKGROUND OF THE INVENTION

The great expansion in recent years of self-service markets has resulted in a need for simple and clear yet attractive means for conveying information such as price and identification to store patrons. In these stores where products are sold directly to the consumer, the goods for sale are generally placed on shelves or in bins or counters on display to the customer and frequently pans or trays are utilized to contain bulk material. It becomes necessary therefore to indicate the item for sale with its name and price so that shoppers can easily find the item that is involved and the price without consultation with persons working in the store.

Since items for purchase are located on shelves and in bins of various configurations, a variety of indicating devices have been developed. An indicating device of this type in order to be useful must be easily mounted and be so designed that the price designation and the item designation can be easily changed when a different item is placed in the bin or shelf or tray or pan or the price changes. A variety of pans or trays are utilized for containing bulk material and accordingly to be useful the indicating device or display sign must be capable of adaptability and attachment to a variety of trays and pans. Trays and pans as can well be imagined come in all sizes, shapes, configurations and are formed from a variety of materials. Varying thicknesses of plastic or metal pans are utilized, some having a straight edge and others having a rolled or contoured edge. Signs useful in connection with pans or trays are generally attached to the edge thereof and in order for the sign or indicating device to be useful, it must be adaptable to the edge of the pan or tray no matter what the tray material is or its thickness or configuration.

SUMMARY OF THE INVENTION

A display sign for attachment to the edge of a pan or tray including in combination a sign body, first and second spaced flanges connected to and depending downwardly from said body, each of said flanges being formed of a resilient material and having shoulder, edge engaging and leg portions, said shoulder portion projecting forwardly below said body, said edge engaging portion projecting downwardly from said shoulder portion, said leg projecting downwardly from said edge engaging portion and rearwardly thereof, said edge engaging portion being arcuately formed to engage a rolled edge of said pan or tray and resiliently urge said leg portion against the side thereof, and a further flange depending from said sign body rearwardly of said first and second flanges whereby said pan or tray edge can be sandwiched between said further flange and said first and second flanges.

DESCRIPTION OF THE PREFERRED EMBODIMENT

Figure 1:
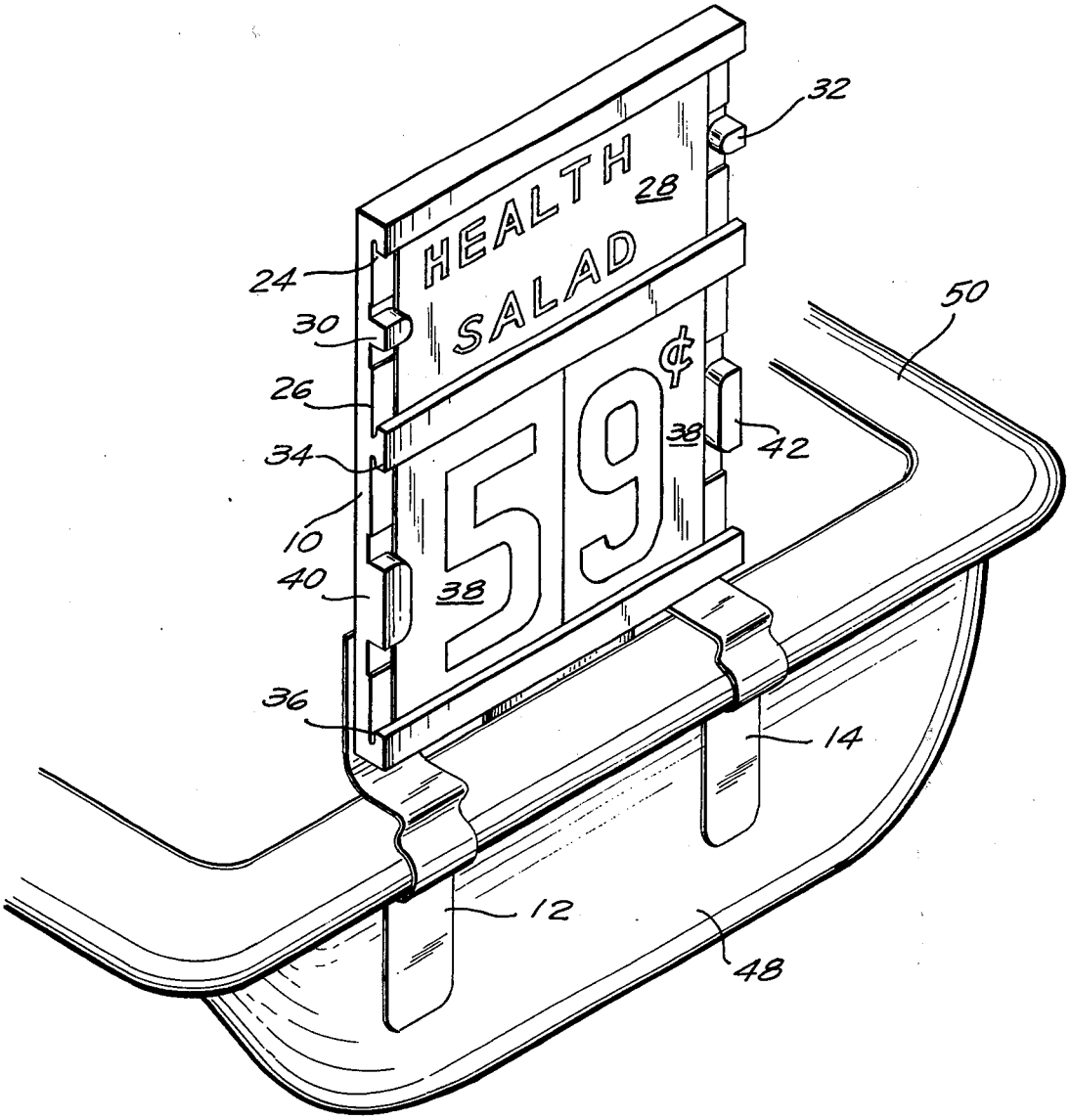
FIG. 1 is a perspective view of a display sign with edge attaching flange members constructed in accordance with the teachings of this invention in position on a typical pan or tray having a rolled edge.
Figure 4:
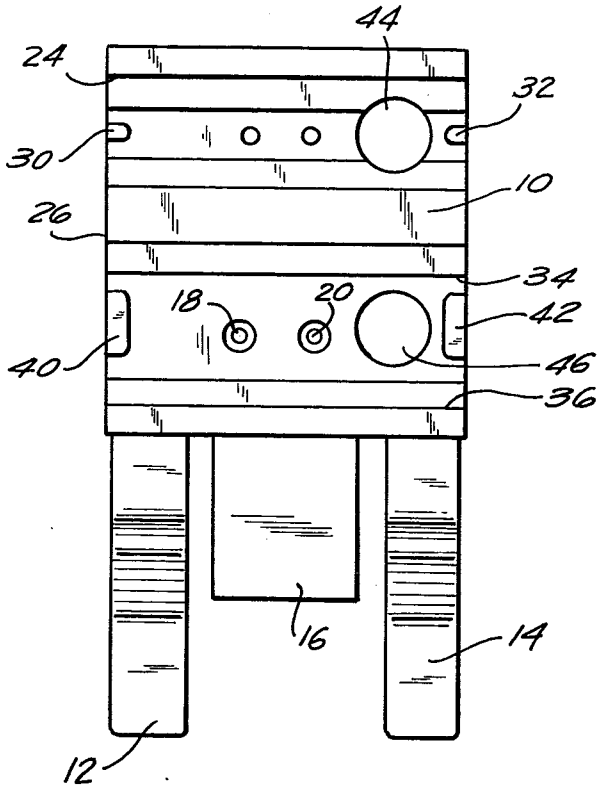
FIG. 4 is a front view of the disengaged sign.
Figure 3:
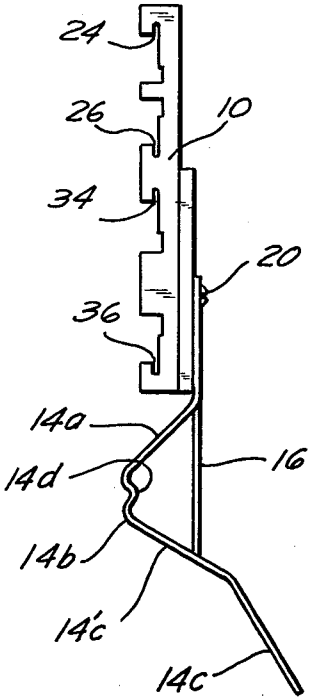
FIG. 3 is a side view of the disengaged sign.
Figure 2:
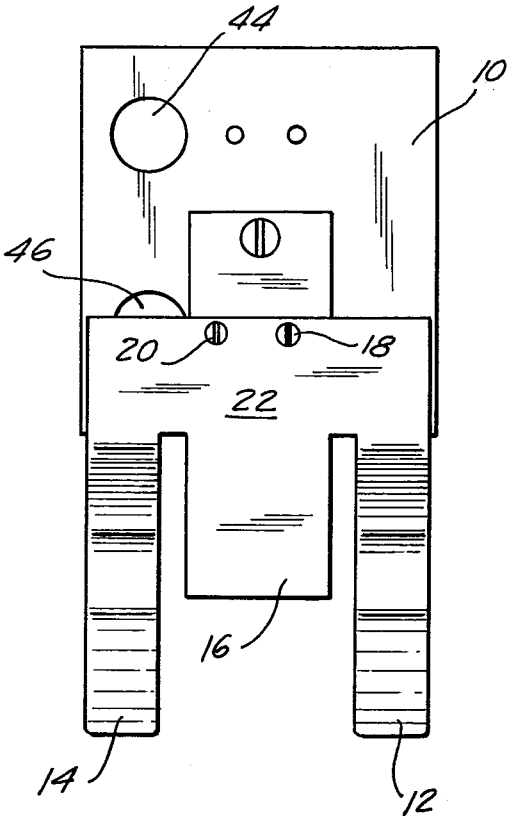
FIG. 2 is a rear view of the sign shown in FIG. 1 disengaged from the pan or tray.

A display sign constructed in accordance with the invention is shown in the Figures in which the numerals 10, 12, 14 and 16 designate respectively the sign body, first and second spaced flanges which are attached to the rear of the body by suitable means such as rivets 18 and 20 through flange holder 22 integral therewith, and further flange 16 which is also integral with holder 22 and depends from said sign body 10 rearwardly of the flanges 12 and 14.

The sign body 10 is formed of any suitable material such as molded plastic and is provided with facing horizontal channels 24 and 26 for slidably and removably receiving product slide 28 between stops 30 and 32. Facing channels 34 and 36 are also provided for displaying price tag slides 38 between stops 40 and 42. Finger holes 44 and 46 are provided in the holder to permit the slides to be changed easily and instantly.

Figure 5:
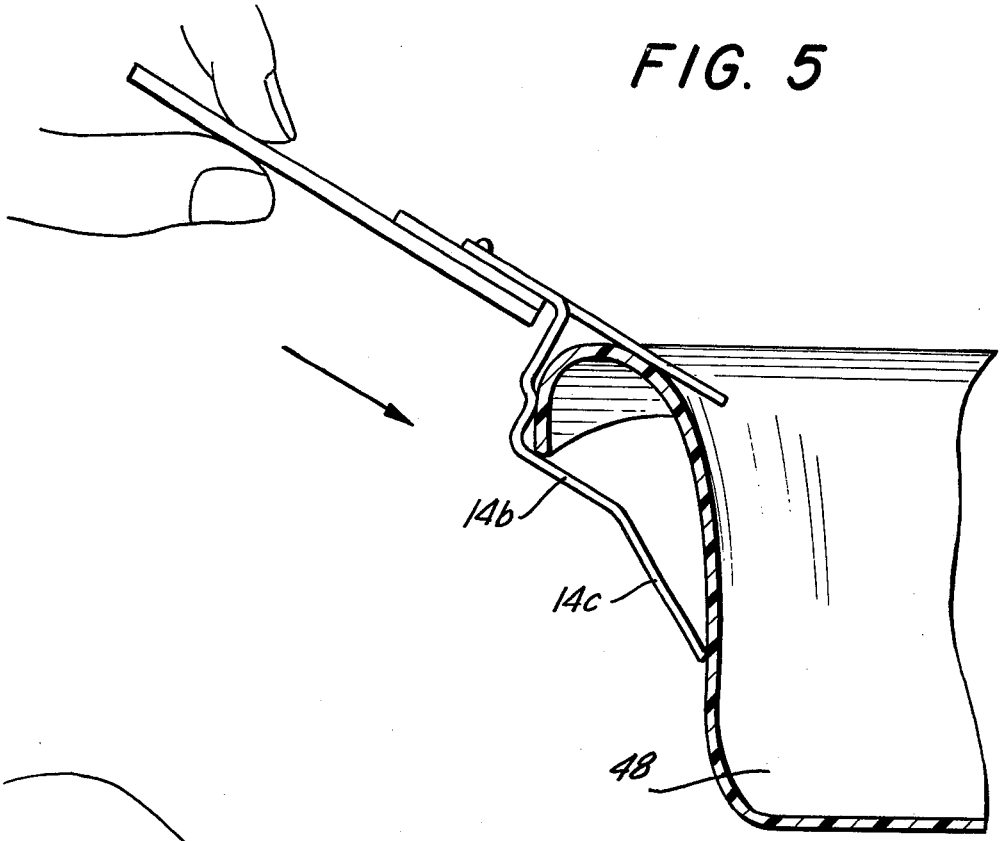
FIG. 5 is a partially sectional side view of the sign in the position of being attached to a pan or tray with the hands of an individual who is making the attachment shown in broken lines.
Figure 6:
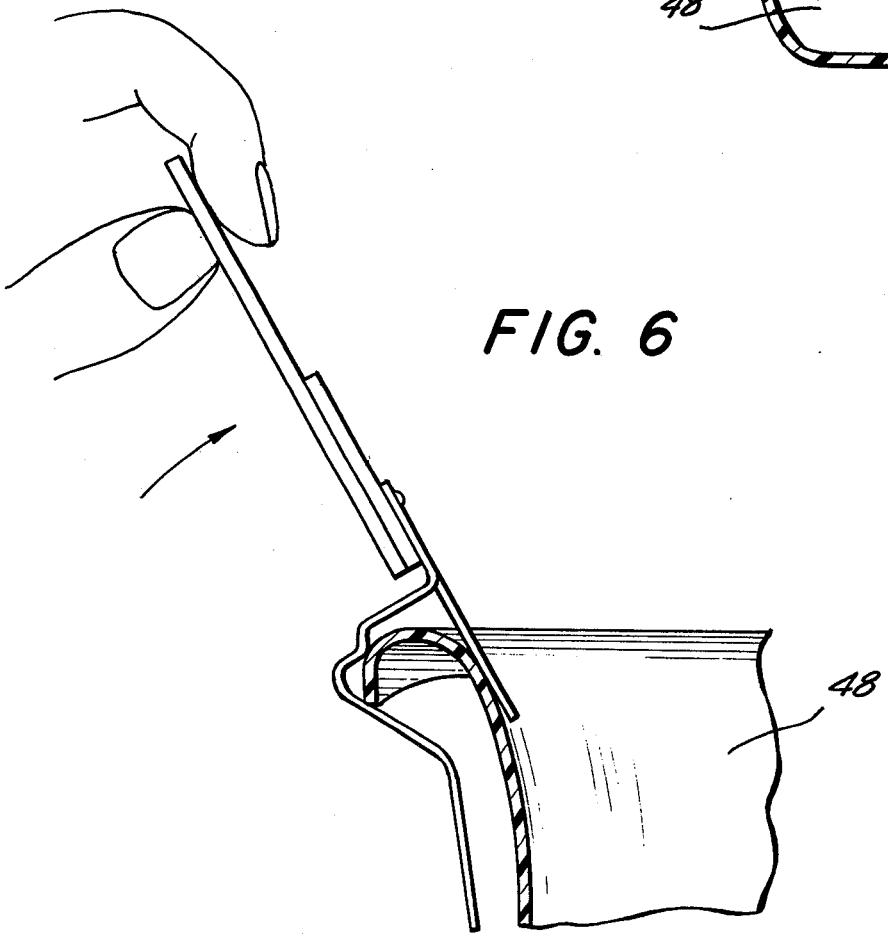
FIG. 6 is a partially sectional side view similar to that of FIG. 5 and with the sign in a further advanced position of engagement with the pan or tray.

In the FIGS. 1, 5 and 6 a tray is shown and designated by the numeral 48. This is a typical tray shown by way of example only as the invention disclosed herein has use with all trays of varying thickness and material including those such as that shown in the Figures having a rolled or curved upper edge 50.

The flanges 12, 14 and 16 as well as the part designated as the flange holder 22 in the drawings are integral and formed from a single piece of flat stainless steel. Of course, any suitable resilient material can be used for this purpose and as will be clear from the description herein, these parts need not be formed integrally.

As shown, the further flange 16 depends downwardly from holder 22 in the vertical plane thereof. Flanges 12 and 14 have a shoulder portion designated with its number followed by the letter A. Hence the shoulder portion of flange 12 is designated in the Figures by the numeral 12A while the shoulder portion of flange 14 is designated by the numeral 14A. Likewise each of the flanges 12 and 14 has an edge engaging portion 12B and 14B and a leg portion projecting downwardly from the edge engaging portion and rearwardly thereof respectively indicated by the numerals 12C and 14C.

Each of the flanges 12 and 14 therefore is attached to portion 22 and depends from the sign downwardly. The shoulder portion 14A for example (the flanges 12 and 14 being identical) projects forwardly of the body and is attached to the leg portion 14C by the edge engaging portion 14B. The edge engaging portion is somewhat arcuately formed with straight sides and shoulder 14A forming one of the sides. The remaining side which is a portion of leg 14C is indicated in the Figures by the numeral 14'C. The edge engaging portion contains a knuckle 14D formed therein which projects rearwardly to "spring load." The edge engaging portion when it is in position on the rolled edge 50 by abutting against the edge creating a tension in the attaching member which do to its resiliency seeks to return to its original position. The edge engaging portion being so formed resiliently urges the leg portion 14C against the side of tray 48 when the sign is mounted thereon and the pan or tray edge is sandwiched between the flange 16 on the one hand and the flanges 12 and 14 which are without the tray.

FIGS. 5 and 6 demonstrate the manner of attaching the sign to the tray edge and slight pressure forward or backward on the flanges will insure a perfect fit regardless of the thickness of plastic or metal pan or configuration of the rolled edge.

I claim:

1. A display sign for attachment to the edge of a tray including in combination a sign body, first and second spaced flanges connected to and depending downwardly from said body, each of said flanges being formed of a resilient material and having shoulder, edge engaging and leg portions, said shoulder portion projecting forwardly below said body, said edge engaging portion projecting downwardly from said shoulder portion, said leg portion projecting downwardly from said edge engaging portion and rearwardly thereof, said edge engaging portion being arcuately formed to engage a rolled edge of said tray and resiliently urge said leg portion against the side thereof, a knuckle formed in said edge engaging portion projecting rearwardly to abut against the edge of said tray to distort said respective flange which due to its resiliency seeks to return to its original configuration, and a further flange depending from said sign body rearwardly of said first and second flanges whereby said tray edge can be sandwiched between said further flange and said first and second flanges.

* * * * *